US005447261A

United States Patent [19]

Mitomi et al.

[11] Patent Number: 5,447,261

[45] Date of Patent: Sep. 5, 1995

[54] CARRIER BAG

[75] Inventors: Masako Mitomi, Yokohama; Ryo Hoshino, Ohta, both of Japan

[73] Assignees: Nifco Inc.; Kabushiki Kaisha Cosmo Area, both of Japan

[21] Appl. No.: 16,223

[22] Filed: Feb. 11, 1993

[30] Foreign Application Priority Data

Feb. 12, 1992 [JP] Japan ..... 4-005152 U

[51] Int. Cl.[6] ..... A45F 4/02

[52] U.S. Cl. ..... 224/153; 224/210; 190/110; 190/18 R; 190/18 A; 280/37; 280/47.18; 280/47.26

[58] Field of Search ..... 224/153, 209, 210, 211; 190/110, 124, 18 R, 18 A, 115, 39, 116, 903; 280/47.18, 47.26, 30, 37, 47.24, 47.331, 8, 5.2

[56] References Cited

U.S. PATENT DOCUMENTS

| | | | |
|---|---|---|---|
| 2,362,807 | 11/1944 | Dresner | 190/110 |
| 3,927,894 | 12/1975 | Zawislak | 280/47.26 |
| 4,550,813 | 11/1985 | Browning | 280/47.26 |
| 4,550,931 | 11/1985 | Ziaylek, Jr. | 280/47.26 |
| 4,593,841 | 6/1986 | Lange | 224/210 |
| 4,756,394 | 7/1988 | Cohen | 190/903 |
| 4,809,893 | 3/1989 | Parsons | 224/210 |
| 4,848,782 | 7/1989 | Schmidt | 280/47.18 |
| 5,215,318 | 6/1993 | Capraro | 280/47.26 |

FOREIGN PATENT DOCUMENTS

| | | | |
|---|---|---|---|
| 813280 | 2/1937 | France | 224/209 |
| 2660170 | 10/1991 | France | 224/210 |
| 4202135 | 7/1993 | Germany | 224/153 |
| 57-51692 | 11/1982 | Japan . | |
| 61-151516 | 9/1986 | Japan . | |
| 63-500776 | 3/1988 | Japan . | |
| 0017691 | of 1903 | United Kingdom | 190/110 |
| 2246545 | 2/1992 | United Kingdom | 280/47.18 |
| 87/01017 | 2/1987 | WIPO . | |

*Primary Examiner*—Linda J. Sholl

*Attorney, Agent, or Firm*—Parkhurst, Wendel & Rossi

[57] ABSTRACT

A carrier bag including a box member having a bottom plate and a plurality of side plates that extend from the outer-periphery of the bottom plate in a direction perpendicular to the plane of the bottom plate. The box member is defined with an opening which is always oriented in an upper-diagonal direction relative to a surface when the box member is positioned on the surface with either the bottom plate or one of the side plates being in contact therewith. Furthermore, the carrier bag is provided with a caster at each corner portion defined between the bottom plate and one of the side plates. The opening is covered with a fastenable and unfastenable cover. The carrier bag is thereby fabricated so as to allow articles to be put therein in downward and side directions in relation to the surface. Thus, the carrier bag provides a choice of storage space for each size and shape of article. Moreover, when the casters are embedded in snow during movement of the carrier bag along snowy ground, the bottom plate assumes an upper-diagonal position with respect to the horizontal ground because of the box member being tilted against drifted snow. As a result, the carrier bag can be trailed along snowy ground because the bottom plate functions as a sledding plate.

12 Claims, 7 Drawing Sheets

CARRIER BAG

FIELD OF THE INVENTION

The present invention relates to a carrier bag for ski gear and the like, and more particularly, to a carrier bag adapted for easy movement on snowy ground.

BACKGROUND OF THE INVENTION

FIG. 7 illustrates a carrier bag 70 which is now in general use. The carrier bag 70 includes a bottom plate 72 and a bag 74. The bag 74 is formed of a nylon material, with a base portion thereof being made open. The bottom plate 72 is made of a synthetic resin material. The bag 74 is rigidly secured to the outer-periphery of the bottom plate 72. The bag 74 includes a slide fastener 78 which zips the bag 74 open and closed. The bottom plate 72 is provided with a caster 78 at each corner portion thereof in order to trail the carrier bag 70 along the ground using a belt 80.

However, this type of carrier bag has a disadvantage in that articles such as ski gear can only be placed in the carrier bag 70 in a top-to-down direction when the carrier bag 70 is open. As a result, some of the articles are inconveniently packed in the carrier bag 70 because of shapes and/or sizes of the articles. Another drawback is that movement of the carrier bag 70 on the snowy ground causes the casters 78 to bury into the snow, which then stops movement thereof. In this case, there is an idea of tilting the carrier bag 70 in the direction of movement in order to drag it. Nevertheless, this does not facilitate pulling the carrier bag 70 therealong because the outer-periphery of the bottom plate 72 becomes stuck in snow, and the carrier bag 70 falls over.

SUMMARY OF THE INVENTION

In view of the above fact, an object of the present invention is to provide a carrier bag, which is efficient for accommodating articles such as ski gear and the like which have different sizes and shapes, and can also be smoothly transported over snowy ground.

A carrier bag according to one aspect of the present invention comprises: a substantially rectangular-shaped box member, which is defined with the outer-periphery of an opening such that the opening is always oriented in an upper-diagonal direction with respect to a substantially horizontal surface when either a first side portion or a bottom portion is positioned against the substantially horizontal surface, both of the first side portion and the bottom portion forming part of the box member; a cover, which is fitted to the outer-periphery of the opening so as to cover the opening in a fastening and unfastening manner; and, a caster, which is disposed at each corner portion defined between the first side portion and the bottom portion, the caster cooperating with the first side portion at a location adjacent to the outer-periphery of the opening, thereby permitting the box member to rest on the substantially horizontal surface.

In the carrier bag according to the aforesaid aspect, the box member is defined with the outer-periphery of the opening so as to put the opening into an upper-diagonal position relative to the substantially horizontal surface when the box member is located on the substantially horizontal surface with either the first side portion or the bottom portion being in contact therewith. This arrangement of the carrier bag allows articles to be placed therein in downward and side directions relative to the substantially horizontal surface. Accordingly, a choice of storage space within the carrier bag can be provided for each shape and size of accommodated articles.

Furthermore, the box member is supported on the horizontal surface by means of the casters and the first side portion at a position adjacent to the opening. In order to move the carrier bag, the box member may be slightly tilted on the casters in a moving direction. The first side portion is then lifted from the ground, thereby allowing the carrier bag to be carted by way of the casters. In addition, the bottom portion is formed with a squarishly raised portion in close proximity to the first side portion. When the carrier bag is moving, for example, on snowy ground, and the casters are embedded in the snow, the bottom portion is then forced into an upper-diagonal position in relation to the horizontal ground because of the box member being tilted against the drifted snow. Accordingly, the side portion or the corner portion between the side portion and the bottom portion performs as a sledding plate. As a result, the carrier bag can be trailed along the snowy ground.

Furthermore, the carrier bag according to the above aspect can be provided with a bag member within the box member in order to contain articles in the bag member. The bag member is held by a belt which is connected to a shaft as well as a second side portion at the reverse side thereof, the shaft being disposed through the box member so as to rotatably support the casters, the second side portion being positioned in a direction opposite the first side portion so as to form part of the box member.

As a consequence, the bag member and the articles put therein can be prevented from being rattled about and disorganized because the bag member can be tightly secured within the box member by means of the aforesaid belts.

DETAILED DESCRIPTION OF THE INVENTION

Figure 1:
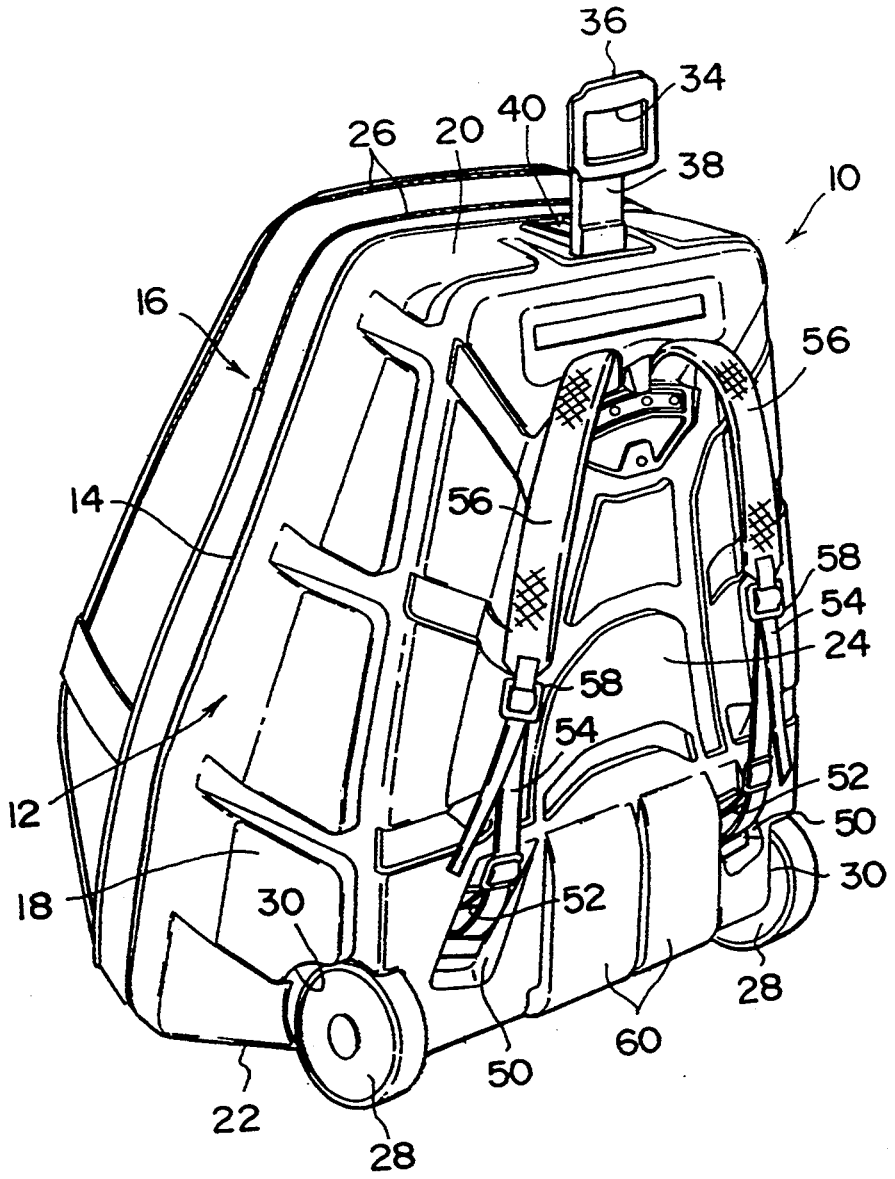
FIG. 1 is an overall perspective view, showing a carrier bag according to the present invention.

FIG. 1 illustrates a carrier bag 10 according to the present invention, which includes a box 12 and a cover 16. The box 12 accommodates ski gear and the like. The cover 16 covers an opening 14 (see FIG. 2) of the box 12.

Figure 3:
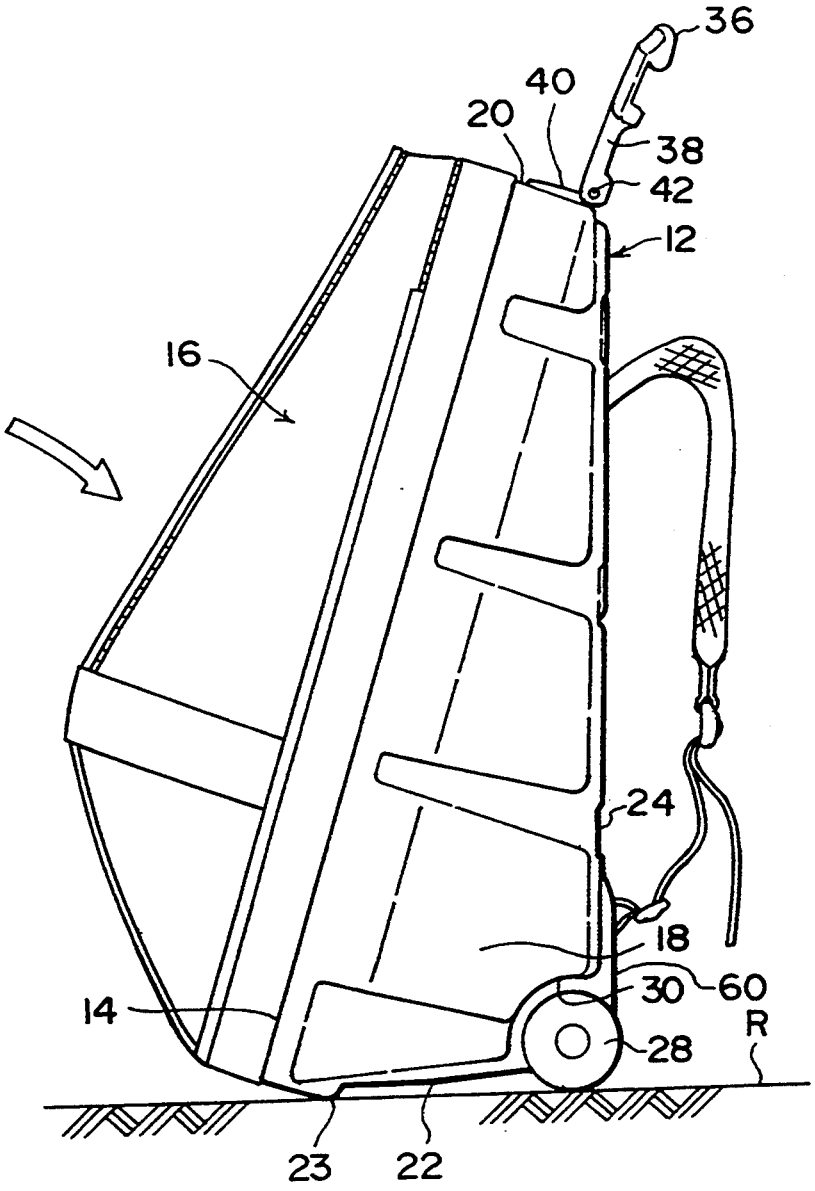
FIG. 3 is a side view, showing a state in which the carrier bag is located on the ground, with a bottom plate of the carrier bag being in contact therewith.
Figure 4:
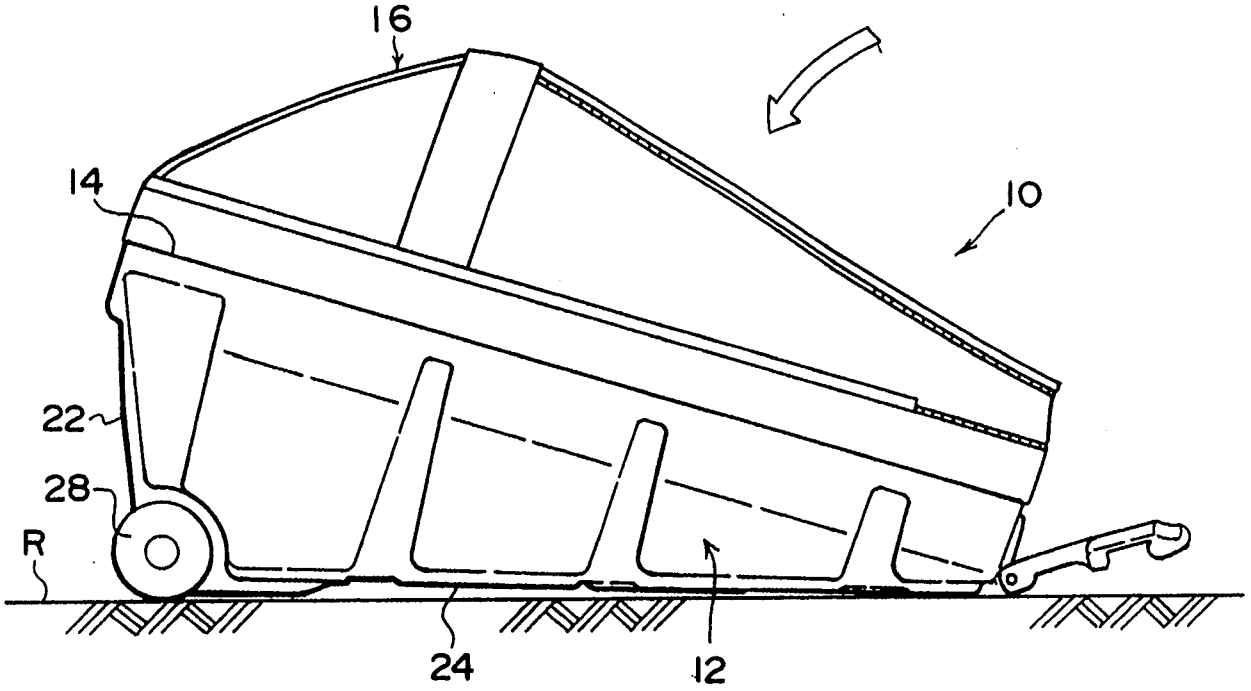
FIG. 4 is a side view, illustrating a state in which the carrier bag is positioned on the ground, with a flat plate of the carrier bag being in contact therewith.

The box 12 is formed of a planar bottom plate 24, a pair of first side plates 18 (see FIG. 3), a second side plate 20, and a third side plate 22, all of which are integrally fabricated from a synthetic resin material. The bottom plate 24 has a substantially rectangular shape, while the pair of first side plates 18 forms a substantially trapezoidal shape. The pair of first side plates 18 extends in a direction perpendicular to the plane of the bottom plate 24 from a pair of side edge portions of the bottom plate 24, the pair of side edge portions being located in a transverse direction of the box 12. The second side plate 20 extends in the direction perpendicular to the bottom plate 24 from one edge portion of the bottom plate 24, the one edge portion being located in a longitudinal direction of the box 12. As a result, first ends of the pair of first side plates 18 in the longitudinal direction thereof are connected together via the second side plate 20. The third side plate 22 extends in the direction perpendicular to the bottom plate 24 from the other edge portion of the bottom plate 24, the other edge portion being located in the longitudinal direction of the box 12. Thus, second, opposite ends of the pair of first side plates 18 in the longitudinal direction thereof are connected together via the third side plate 22. As illustrated in FIGS. 3 and 4, the opening 14 of the box 12 is thereby defined so as to assume an upper-diagonal position relative to the horizontal ground R when the box 12 rests on the horizontal ground R with either the third side plate 22 or the bottom plate 24 being in contact therewith.

Referring back to FIG. 1, the sheet-shaped cover 16 is rigidly secured to the outer-periphery of the opening 14 by way of sewing, an adhesive, and the like. The cover 16 is made of a water-proofed nylon material. The cover 16 is provided with several slide fasteners 26 on an outer-peripheral surface portion of the cover 16 in order to open and close the cover 16.

A concave portion 30 is formed at each location where three members consisting of the third side plate 22, the bottom plate 24, and the pair of first side plates 18 intersect. The concave portions 30 have casters 28 disposed therein. The concave portions 30 further have a shaft 32 (see FIG. 2) provided therethrough, which rotatably supports the casters 28. In addition, as seen from FIG. 3, the third side plate 22 has a protruding portion 23 defined near the opening 14. Accordingly, the box 12 is provided with the pair of casters 28 in such a way that the box 12 is supported by the protruding portion 23 and circumferential surfaces of the pair of casters 28 when positioned on a horizontal surface R with the third side plate 22 being in contact therewith.

As shown in FIG. 1, the second side plate 20 has a handle 36 disposed on an outer surface thereof. The handle 36 has an opening 34 in the middle thereof. The opening 34 is large enough to allow user's fingers to enter therethrough. Furthermore, the handle 36 is integrally formed with a rectangular-shaped connecting plate 38. In addition, the second side plate 20 has a plate member 40 fixed to the outer surface thereof. In this way, the connecting plate 38 is pivotably held to the plate member 40 via a pin 42. (See FIG. 3 for the pin 42.) In addition, the pin 42 has an unillustrated helical torsion spring provided therearound. The helical torsion spring is positioned at one end against the connecting plate 38 and against the plate member 40 at the other. The handle 36 is thereby allowed to be placed down on the second side plate 20 in a state of being held in surface contact with the second side plate 20 due to the urging force of the helical torsion spring.

Figure 2:
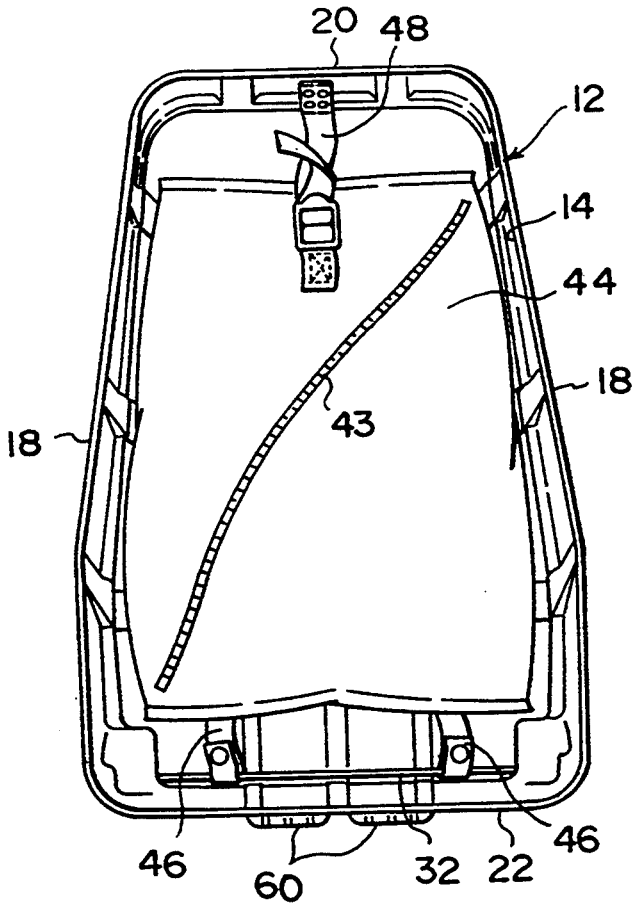
FIG. 2 is an elevational view, illustrating the inside of the carrier bag.

Attention can now be directed to FIG. 2, in which a bag 44 is provided within the box 12. The bag 44 includes a slide fastener 43 which zips and unzips the bag 44. A pair of belts 46 are attached to one edge portion of the bag 44 (i.e., the lower side of FIG. 2). The bag 44 further has a belt 48 fitted to the other edge portion thereof (at the upper side of FIG. 2). The pair of belts 46 is held around the shaft 32, while the belt 48 is anchored to the reverse side (i.e., an inner surface) of the second side plate 20. The bag 44 is thereby securely held within the box 12.

Again, referring back to FIG. 1, the bottom plate 24 has a pair of hollow portions 50 defined at both end portions thereof adjacent to the third side plate 22. The pair of hollow portions 50 has a pair of rings 52 fixed therein so as to permit first ends of a pair of belts 54 to extend through the pair of rings 52. The second, opposite ends of the pair of belts 54 are connected to a pair of shoulder belts 56 via a pair of buckles 58. The pair of shoulder belts 56 is anchored to the bottom plate 24 at positions adjacent to the second side plate 20. The carrier bag 10 can thereby be carried as a backpack as well.

The bottom plate 24 is further formed with a pair of raised portions 60 at a lower portion thereof (in close proximity to the third side plate 22). To be specific, the pair of raised portions 60 is located between the pair of casters 28.

Next, the operation of a carrier bag 10 according to the present invention will be described.

As illustrated in FIGS. 3 and 4, a box 12 is located on the ground, with either a bottom plate 24 or a third side plate 22 being in contact therewith. In these positions, articles can be put in the carrier bag 10 in downward and side directions in relation to the ground. The carrier bag 10 thereby provides a choice of storage space for each shape and size of accommodated articles.

Figure 5:
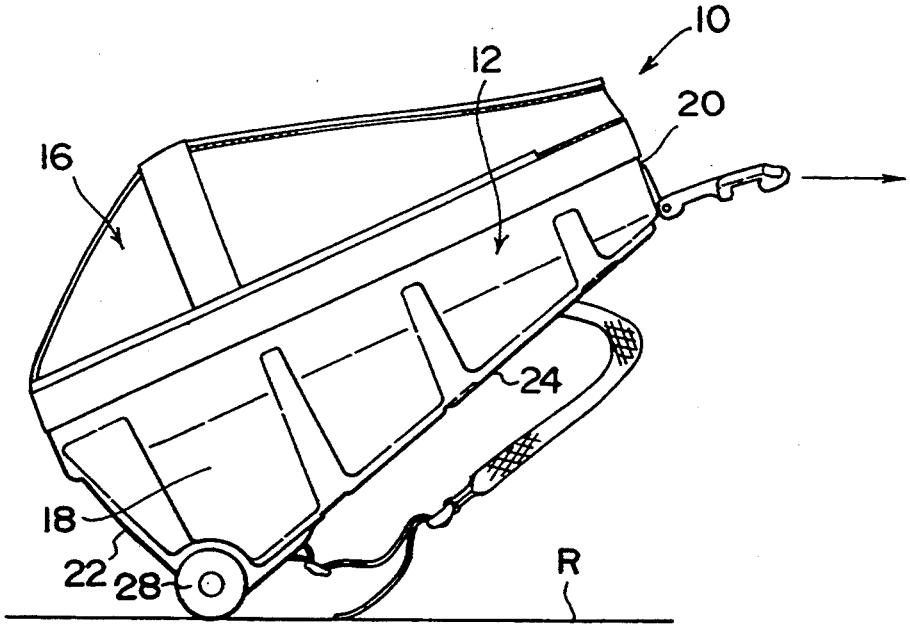
FIG. 5 is a side view, illustrating the carrier bag in a state of traveling on the ground.
Figure 6:
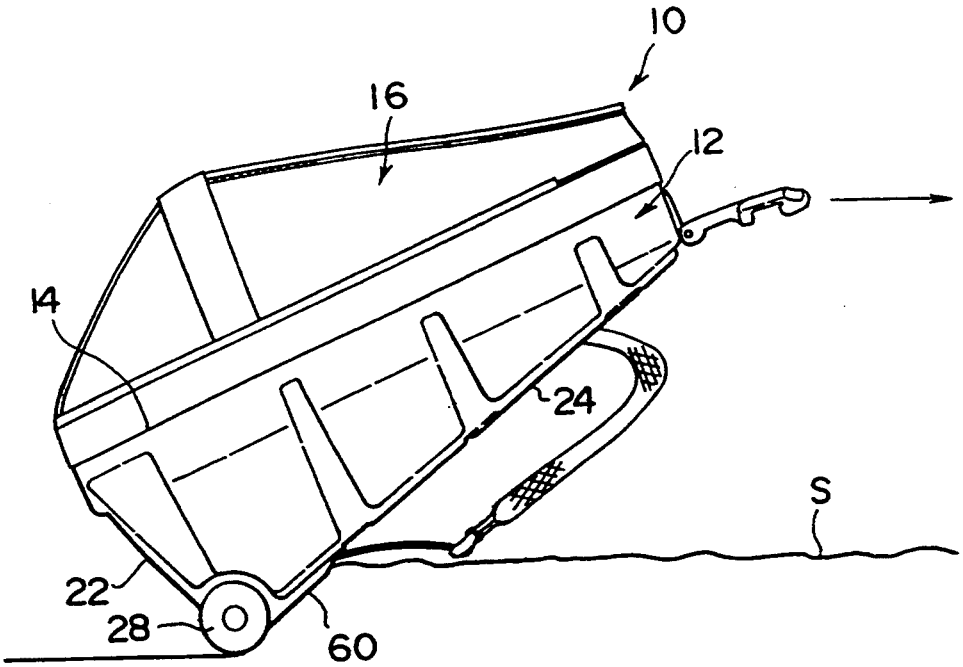
FIG. 6 is a side view, showing the carrier bag in a state of moving on snowy ground; and, FIG. 7 is a perspective view, representing a conventional carrier bag.
Figure 7:
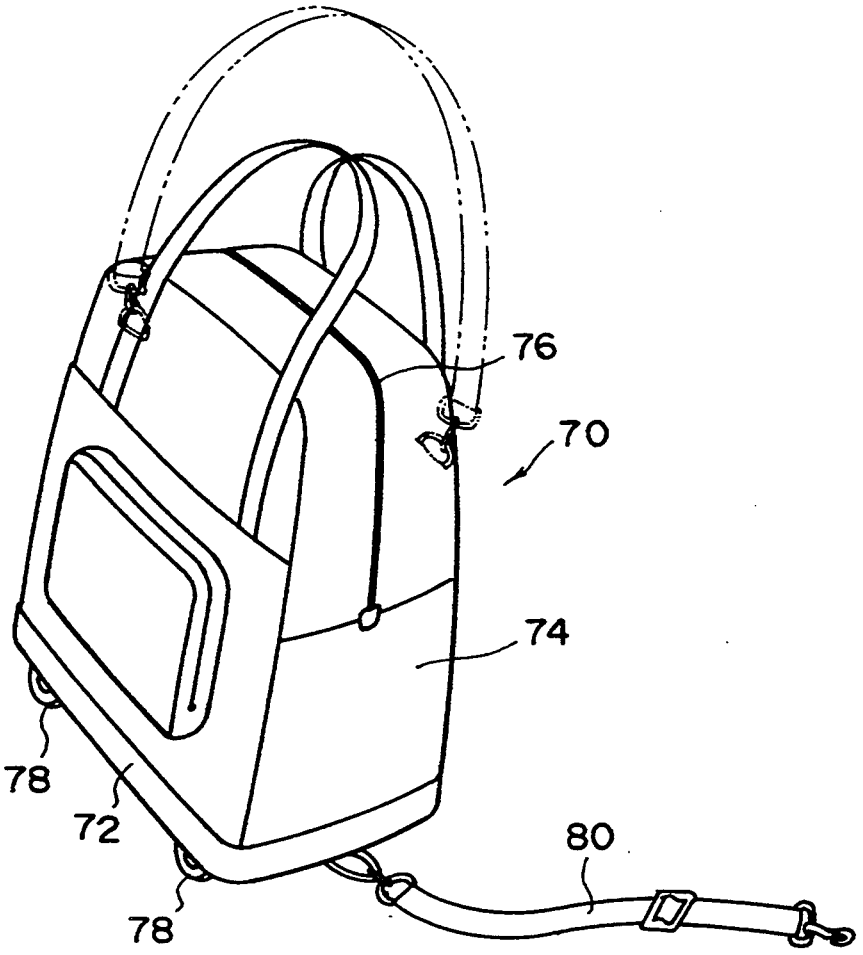
FIG. 7 PRIOR ART

Furthermore, as seen from FIG. 3, the box 12 usually rests on the horizontal surface R by the aid of a pair of casters 28 and a protruding portion 23 that is defined on the third side plate 22. In order to move the carrier bag 10, the box 12 may be slightly tilted about the pair of casters 28 in a moving direction, as illustrated in FIG. 5. The protruding portion 23 is then lifted off the surface R, so that the carrier bag 10 is ready for movement by means of the pair of casters 28. With further reference to FIG. 6, when the pair of casters 28 is buried in snow during movement of the carrier bag 10 on snowy ground S, the bottom plate 24 assumes an upper-diagonal position in relation to the horizontal surface because of the box 12 being leaned against the drifted snow. Accordingly, the bottom plate 24, in particular, a pair of raised portions 60 defined thereon acts as a sledding plate As a consequence, the carrier bag 10 can be slid along the snowy ground S.

Moreover, as shown in FIG. 2, the bag 44 is disposed inside the carrier bag 10. The bag 44 is tightly secured within the box 12 by means of the pair of belts 46 and one belt 48 which are respectively connected to the shaft 32 and the reverse side of a second side plate 20. Thus, the articles packed in the bag 44 are prevented from being rattled around and upset during the movement of the carrier bag 10.

As described above, the carrier bag according to the present invention can be drawn along the snowy ground in sliding contact therewith because a planar plate of the box serves as a sledding plate. Furthermore, the carrier bag permits articles to be put therein in downward and side directions in relation to the ground. The carrier bag thereby provides a choice of storage space for each shape and size of article.

What is claimed is:

1. A carrier bag comprising:

a box member formed by a bottom plate and side plates extending from an outer periphery of said bottom plate, said side plates including a lower side plate and forming a peripheral edge which forms an opening which lies in a plane inclined with respect to said bottom plates a cover attached to said peripheral edge of said side plates, said cover covering said opening;

a connecting member provided along said cover to allow said cover to be partially openable;

first and second casters each being provided at a respective corner portion of said box member, and when said lower side plate is disposed horizontally, said first and second casters support said box member such that said bottom plate is in a substantially vertical state;

a shaft having first and second opposite ends for axially supporting said first and second casters, respectively, said shaft penetrating inside said box member; and a bag body disposed inside said box member, a first end of the bag body being connected to said shaft and a second end of the bag body being connected to the side plate opposite said first and second casters.

2. The carrier bag according to claim 1, wherein said connecting member is a fastener.

3. The carrier bag according to claim 2, wherein said fastener is a slide fastener.

4. The carrier bag according to claim 1, further comprising a sliding surface including raised portions extending partially along said bottom plate.

5. The carrier bag of claim 4, wherein said raised portions are centrally disposed between said first and second casters.

6. The carrier bag according to claim 1, further comprising a handle extending from a side plate of said box member at a side which is opposite said first and second casters.

7. The carrier bag according to claim 6, wherein said handle is adapted to be set in one of an orthogonal state and an inclined state with respect to said side plate.

8. The carrier bag according to claim 1, further comprising a protruding portion adjacent said peripheral edge along said lower side plate for supporting, together with said casters, said box member such that said bottom plate is in a substantially vertical state.

9. The carrier bag according to claim 1, wherein said cover is comprised of a fabric material.

10. The carrier bag according to claim 9, wherein said fabric material is nylon.

11. The carrier bag according to claim 1, wherein said box member is comprised of a rigid material.

12. The carrier bag according to claim 11, wherein said rigid material is a synthetic resin.

* * * * *